US008265929B2

(12) United States Patent
Lee et al.

(10) Patent No.: US 8,265,929 B2
(45) Date of Patent: Sep. 11, 2012

(54) EMBEDDED CODE-EXCITED LINEAR PREDICTION SPEECH CODING AND DECODING APPARATUS AND METHOD

(75) Inventors: Mi-Suk Lee, Daejon (KR); Do-Young Kim, Daejon (KR); JongMo Sung, Daejon (KR); Hyun-Woo Kim, Seoul (KR)

(73) Assignee: Electronics and Telecommunications Research Institute (KR)

( * ) Notice: Subject to any disclaimer, the term of this patent is extended or adjusted under 35 U.S.C. 154(b) by 1291 days.

(21) Appl. No.: 11/297,686

(22) Filed: Dec. 7, 2005

(65) Prior Publication Data

US 2006/0122830 A1 Jun. 8, 2006

(30) Foreign Application Priority Data

Dec. 8, 2004 (KR) ..... 10-2004-0103156
Aug. 23, 2005 (KR) ..... 10-2005-0077355

(51) Int. Cl.
*G10L 19/02* (2006.01)

(52) U.S. Cl. ..... 704/229; 370/290; 702/189; 704/207; 704/216; 704/219; 704/220; 704/223; 704/224; 704/258; 704/500

(58) Field of Classification Search ..... 704/219, 704/220, 223, 258, 189, 207, 216, 224, 500; 370/290
See application file for complete search history.

(56) References Cited

U.S. PATENT DOCUMENTS 5,519,807 A * 5/1996 Cellario et al. ..... 704/224
5,664,055 A * 9/1997 Kroon ..... 704/223
5,704,003 A * 12/1997 Kleijn et al. ..... 704/220
5,854,998 A * 12/1998 Flomen et al. ..... 704/223
5,960,389 A * 9/1999 Jarvinen et al. ..... 704/220
6,192,334 B1 * 2/2001 Nomura ..... 704/219
6,334,105 B1 * 12/2001 Ehara ..... 704/258
6,577,606 B1 * 6/2003 Lee et al. ..... 370/290

(Continued)

FOREIGN PATENT DOCUMENTS

JP 11-88549 3/1999

(Continued)

OTHER PUBLICATIONS

A. Kataoka et al., "A 16-kbit/s Wideband Speech Codec Scalable With G.729," in Proc. Eurospeech, Rhodes, Greece, pp. 1491-1494, Sep. 1997.

(Continued)

*Primary Examiner* — Michael Colucci
(74) *Attorney, Agent, or Firm* — Blakely, Sokoloff, Taylor & Zafman

(57) ABSTRACT

Provides is an embedded code-excited linear prediction speech coding/decoding apparatus and method that can deal with the capacity change of speech transmission channel by modeling an error signal not coded at a core speech coder based on a transmission rate in a multiple pulse search mode or gain compensation mode and then transmitting it in an optimum mode. The apparatus includes a core speech coding unit for coding an input speech signal with spectral envelop and an excitation signal, a transmission rate determination unit for allocating the number of bits additionally allowed depending on a capacity of a transmission channel, and an embedded excitation signal coding unit for coding a residual excitation signal that is not coded in the core speech coding unit based on the number of additionally allowed bits using one of a multiple pulse excitation coding mode and a gain compensation mode.

18 Claims, 4 Drawing Sheets

U.S. PATENT DOCUMENTS

| | | | | |
|---|---|---|---|---|
| 6,704,703 | B2 | 3/2004 | Ferhaoul et al. | |
| 6,738,733 | B1 * | 5/2004 | Tian | 702/189 |
| 6,766,289 | B2 * | 7/2004 | Kandhadai et al. | 704/207 |
| 6,789,059 | B2 * | 9/2004 | Kandhadai et al. | 704/216 |
| 7,392,195 | B2 * | 6/2008 | Fejzo | 704/500 |
| 2001/0044717 | A1 * | 11/2001 | Ferhaoui et al. | 704/223 |
| 2003/0177004 | A1 * | 9/2003 | Jabri et al. | 704/219 |
| 2004/0102963 | A1 | 5/2004 | Li | |

FOREIGN PATENT DOCUMENTS

KR 10-2005-0073561 7/2005

OTHER PUBLICATIONS

Toshiyuki Nomura et al., "A bitrate and bandwidth scalable CELP coder," in Proc. ICASSP, Seattle, WA, pp. 341-344, May 1998.

Sung-Kyo Jung et al., "A cascade algebraic codebook structure to improve the performance of speech coder," in Poc. ICASSP, Hong Kong, China, vol. 2, pp. 173-176, Apr. 2003.

"Dual rate speech coder for multimedia communications transmitting at 5.3 and 6.3 kbits/s", ITU-T Recommendation G.723.1, Mar. 1996.

"Coding of speech at 8 kbits/s using conjugate-structure algebraic-code-excited linear-prediction (CS-ACELP)", ITU-T Recommendation G.729, Mar. 1996.

"Final draft international stanadard FDIS 14496-3: Coding of audio-visual objects, part 3: Audio", ISO/JTC1 SC29 WG 11, 1998.

"Perceptual evaluation of speech quality (PESQ): an objective method for end-to-end speech quality assessment of narrow-band telephone networks and speech codecs", ITU-T Recommendation P.862, Feb. 2001.

* cited by examiner

| Bit rate (kbps) | Mode | Selected method | PESQ (MOS) |
|---|---|---|---|
| 9.5 | NB-CORE | | 3.944 |
| 10.3 | NB-1 | Multiple pulse search | 3.968 |
| 11.1 | NB-2 | Multiple pulse search | 3.986 |
| 11.9 | NB-3 | Gain compensation | 3.997 |
| 12.7 | NB-4 | Multiple pulse search | 4.012 |
| 13.5 | NB-5 | Multiple pulse search | 4.021 |
| 14.3 | NB-6 | Multiple pulse search | 4.027 |
| 15.1 | NB-7 | Gain compensation | 4.036 |

EMBEDDED CODE-EXCITED LINEAR PREDICTION SPEECH CODING AND DECODING APPARATUS AND METHOD

FIELD OF THE INVENTION

The present invention relates to an embedded code-excited linear prediction speech coding and decoding apparatus and method; and more particularly, to a bit rate scalable speech coding and decoding apparatus which has an embedded structure capable of improving the quality of speech while actively dealing with fluctuation of speech transmission channel capacity, and a method thereof.

DESCRIPTION OF RELATED ART

High quality speech coders that may be used for speech communication over Internet protocol in a broadband convergence network have been actively developed in recent years.

Such speech coders should be compatible with conventional standard speech coders to include existing conventional coder users. In order to serve compatibility with the conventional coders, the speech coder to be developed should include a core layer based on the conventional speech coder.

Further, in order to guarantee the speech quality in a communication network, particularly in a packet-based network, it is important to provide a variable transmission rate depending on the network traffic condition. For instance, in case of Internet Protocol (IP) network, the fluctuation of speech quality during the speech service may be high due to a packet loss which can occur during packet transmission. Although many speech coders have packet loss concealment algorithm, the speech signals of a lost frame are not perfectly recovered, especially when burst packet loss occurs, the speech quality degradation is severe. Thus the overall speech quality felt by listeners is degraded. One of the causes of the packet loss is a channel load.

Thus, the packet loss caused by channel load can be reduced by controlling the output bitrate of speech coder. On the other hand, the channel load is high, it is possible to transmit the speech data at lower bitrates and reduce the channel load. Thus the fluctuation of speech quality is decreased due to the packet loss. When channel condition is good, speech data can be transmitted at a higher bit rate to thereby provide a high quality speech service.

That is, the speech coder should be implemented in a variable bitrates embedded type and the bit rate can be controlled depending on a network condition.

Meanwhile, conventional scalable speech coders are classified into a separate scalable coding method and a composite scalable coding method.

In case of the separate scalable coding method, first, the input speech signal is coded using a core speech coder and then the difference between the input speech signal and the compressed speech signal is coded again at a bit rate allocated additionally. For example, Kataoka et al. adopt G.729 as a core speech coder and encode a residual signal using a fixed codebook comprised of a combination of two random codebooks (A. Kataoka. S. Kurihara, S. Sasaki, and S. Hayashi, "A 16-kbit/s wideband speech codec scalable with G.729," in Proc. Eurospeech, Rhodes, Greece, pp. 1491-1494, September 1997).

The composite scalable coding method allocates bits in a way of enhancing resolution of the core speech coder, rather than preparing a separate enhancement layer. For example, the CELP speech coder of MPEG-4 employs an enhancement excitation method that increases the number of pulses of regular pulse excitation signal at an increased rate of 2 kbit/s (ISO/JTC1 SC29 WG 11, Final draft international standard FDIS 14496-3: Coding of audiovisual objects, part 3: Audio, 1998). As another example, Nomura et al. adopt a multi-pulse CELP speech coder as a core speech coder to implement a scalable bit rate by increasing the number of multiple pulses which are used for exciting signal modeling (T. Nomura, M. Iwadare, M. Serizawa, and K. Ozawa, "A bitrate and bandwidth scalable CELP coder," in Proc. ICASSP, Seattle, Wash., pp. 341-344, May 1998). In addition, a bit rate scalable speech coder has been recently materialized with a multi-step structure of algebraic codebook in a cascade form at a selective mode vocoder (S.-K. Jung, K.-T. Kim, H.-G. Kang, and D.-H. Youn, "A cascade algebraic codebook structure to improve the performance of speech coder," in Poc. ICASSP, Hong Kong, China, vol. 2, pp. 173-176, April 2003).

However, these methods in the art require a great number of bit rates to provide bitrate scalability. In particular, an improvement is required to provide about 1 kbit/s step bitrate scalability.

SUMMARY OF THE INVENTION

It is, therefore, an object of the present invention to provide an embedded code-excited linear prediction speech coding apparatus and method, which is capable of dealing with actively the capacity change of a transmission channel by modeling an error signal that is not represented at a core speech coder based on a channel transmission rate in a multiple pulse search mode or a gain compensation mode and then transmitting it in an optimum mode.

Another object of the invention is to provide an embedded code-excited linear prediction speech decoding apparatus and method for decoding a speech signal from a bit stream that is coded and transmitted at an embedded code-excited linear prediction speech coding apparatus.

In accordance with one aspect of the present invention, there is provided a speech coding apparatus which includes: a core speech coding unit for compressing an input speech signal with spectral envelop and excitation signal; a transmission rate determination unit for allocating the number of bits that are additionally allowed depending on a capacity of a transmission channel; and an embedded excitation signal coding unit for coding a residual excitation signal that is not coded in the core speech coding unit based on the number of additionally allowed bits using one of a multiple pulse excitation coding mode and a gain compensation mode.

In accordance with another aspect of the present invention, there is provided a speech decoding apparatus comprising: an excitation signal reproduction unit for decoding a basic excitation signal of speech using the contributions of an adaptive codebook and an algebraic codebook; an embedded excitation signal reproduction unit for decoding an excitation signal from a bit stream added in an embedded type; and a linear prediction synthesis filtering unit for reconstructing the speech signal by performing linear prediction synthesis filtering of decoded excitation signals from the excitation signal reproduction unit and the embedded excitation signal reconstruction unit.

In accordance with still another aspect of the present invention, there is provided a speech coding method which includes the steps of: a) modeling a speech signal using a conventional speech coder; and b) coding a residual excitation signal of speech which is not coded via the conventional speech coder based on a channel transmission rate using one of a multiple pulse excitation coding mode and a gain compensation mode.

In accordance with still yet another aspect of the present invention, there is provided a speech decoding method which includes the steps of: a) decoding a basic excitation signal of speech using an adaptive codebook and an algebraic codebook information; b) decoding an excitation signal from a bit stream added in an embedded type; and c) recovering a speech signal by performing a linear prediction synthesis filtering of the excitation signals decoded at said steps a) and b).

The other objectives and advantages of the invention will be understood by the following description and will also be appreciated by the embodiments of the invention more clearly. Further, the objectives and advantages of the invention will readily be seen that they can be realized by the means and its combination specified in the claims.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

The above-mentioned objectives, features, and advantages will be more apparent by the following detailed description in association with the accompanying drawings; and the technical spirit of the invention will be readily conceived by those skilled in the art to which the invention belongs. Further, in the following description, well-known arts will not be described in detail if it appears that they could obscure the invention in unnecessary detail. Hereinafter, a preferred embodiment of the present invention will be set forth in detail with reference to the accompanying drawings. Meanwhile, the modeling used in the following description will be given to have the same meaning as coding.

Figure 1:
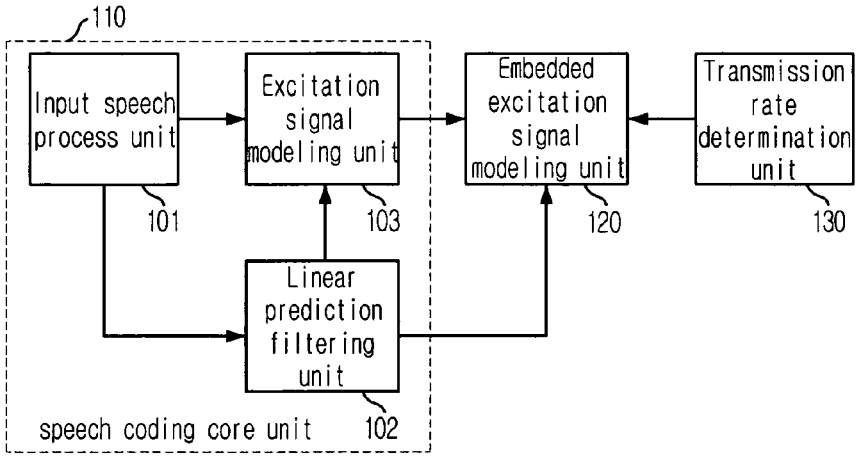
FIG. 1 is a block diagram of an embedded code-excited linear prediction speech coding apparatus in accordance with one embodiment of the present invention.

FIG. 1 is a block diagram of an embedded code-excited linear prediction speech coding apparatus in accordance with the invention. As shown therein, the embedded code-excited linear prediction speech coding apparatus of the invention comprises a core speech coding unit 110, an embedded excitation signal modeling unit 120 and a transmission rate determination unit 130.

In the core speech coding unit 110, the speech signal is presented by spectrum envelop and excitation, wherein ITU-T G.723.1 coder (ITU-T Recommendation G.723.1, Dual rate speech coder for multimedia communications transmitting at 5.3 and 6.3 kbits/s) which has a transmission rate of 6.3 kbits/s or 5.4 kbits/s, or ITU-T G.729 coder (ITU-T Recommendation G.729, Coding of speech at 8 kbits/s using conjugate-structure algebraic-code-excited linear-prediction (CE-ACELP)) which has a transmission rate of 8 kbits/s, etc. may be used. Other coders may be used for the purpose. The core speech coding unit 110 includes an input speech process unit 101, a linear prediction filter unit 102 and an excitation signal modeling unit 103 in the embodiment of the present invention.

Specifically, the input speech process unit 101 buffers a digital speech signal inputted from the outside and then obtains a speech of a short segment using a window function and so on. For example, a speech signal sampled at 8 kHz is inputted every 0.125 msec and the input speech process unit 101 keeps the input speech signal received every 0.125 msec for 10 msec or 20 msec and then applies the window function. That is, the input speech process unit 101 gathers 80 or 160 samples and then applies the window function. As such, the speech of 10 or 20 msec period is named a short segment speech, which is referred as a frame hereinafter. Meanwhile, the speech signal from the outside may be a digital signal that is inputted via a microphone and sampled by an analog/digital converter, or a digital signal that is provided directly as a digital from a digital speech storage media including CD-ROM, MP3 player, DVD, etc., and converted at a desired sampling rate via a decimeter. However, the digital signal is not limited to the above signals and may be any other digital signals.

The linear prediction filter unit 102 obtains Linear Prediction Coefficient (LPC) from the speech signal of one frame received from the input speech process unit 101. The LPC is expressed as Line Spectrum Pair (LSP) or its equivalent parameter and then quantized.

In the excitation signal modeling unit 103, an excitation signal which is output of LP analysis filter is compressed. The periodical components of the excitation signal are presented by adaptive codebook (codebook index, gain) and a non-periodic components of the excitation signal are presented by algebraic codebook (codebook index, gain). Thus the adaptive codebook index and gain, and algebraic codebook index and gain are obtained in the excitation signal modeling unit 103 and then quantized. In this process, for example 8 k bit/s G.729, about 3.4 kbits/s of total 8 kbits/s are allocated to quantize the algebraic codebook index and gain. Thus, in case where an algebraic codebook is used as a secondary codebook of a scalable speech coder, it is difficult to implement a small step size bitrates scalable speech coder.

In the meantime, the embedded excitation signal modeling unit 120, which is a block devised in the present invention, encodes the residual excitation signal which is not encoded in the excitation signal modeling unit 103 of core speech coder. The residual excitation signal is encoded again according to the additionally allocated bits at the transmission rate determination unit 130. That is, the embedded excitation signal modeling unit 120 presents the excitation signal with a position and a sign of pulses based on a multiple pulse excitation model and at the same time presents it with a gain compensation coefficient; and then selects one mode based on mean square error. Finally, the embedded excitation signal modeling unit 120 determines which of the presenting methods is optimal for the excitation signal coding between the position and sign of the pulses and the gain compensation coefficient, and then quantizes for transmission. During this process, if the quantized additional bits are less than the bits given by the transmission rate determination unit 130, this process described above is repeatedly performed until the given bitrate is obtained.

Figure 2:
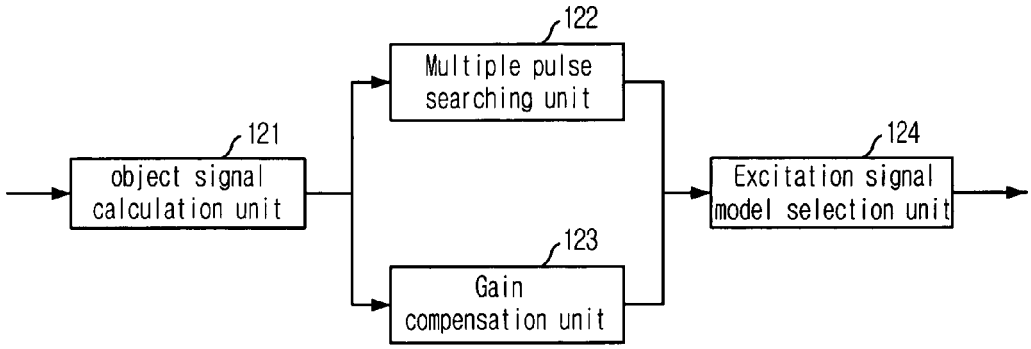
FIG. 2 is a detailed block diagram of the embedded excitation signal modeling unit shown in FIG. 1.

FIG. 2 is a detailed block diagram of the embedded excitation signal modeling unit 120 of FIG. 1. As shown, the embedded excitation signal modeling unit 120 of FIG. 1 includes an object signal calculation unit 121, a multiple pulse search unit 122, a gain compensation unit 123 and an excitation signal model selection unit 124 as shown in FIG. 2. For illustration, it is first assumed that the core speech coding unit 110 is a ITU-T G.729 coder and a given one frame is divided into two subframes. And a codebook search results at a kth subframe determined in the excitation signal modeling unit 103 of the core speech coding unit 110 is defined as follows:

$x_k(n)$: adaptive codebook excitation signal $g_{p,k}$: adaptive codebook gain value $c_k(n)$: algebraic codebook excitation signal $g_{c,k}$: algebraic codebook gain value $N_s$: the number of samples of subframe.

The object signal calculation unit 121 computes an object signal or residual signal to be modeled at the embedded excitation signal modeling unit 120. That is, the object signal calculation unit 121 adds the contributions of an algebraic codebook and an adaptive codebook determined at the excitation signal modeling unit 103, performs a linear prediction synthesis, and then obtains the object signal by subtracting the filtered signal from the original input speech signal. Each object signal to be modeled at the multiple pulse search unit 122 and the gain compensation unit 123 may be calculated using the following equations 1 and 2:

$$s(n)-(g_{p,k}x_k(n)*h_k(n)+g_{c,k}c_k(n)*h_k(n)) \quad \text{Eq. (1)}$$

$$s(n)-(g_{p,k}x_k(n)*h_k(n)+g^m g_{c,k}c_k(n)*h_k(n)) \quad \text{Eq. (2)}$$

Wherein s(n) is an original input speech signal and $h_k(n)$ is an impulse response of synthesis filter.

The multiple pulse search unit 122 models the object signal of Eq. (1) above as a position and a sign of multiple pulses. That is, the multiple pulse search unit 122 finds the pulse position and sign which give the greatest influence on the speech quality, wherein it seeks a pulse position $p^m$ and a sign $s^m$ at that pulse location which satisfies the following equation 3. This is to find $c^m(n)$ in the equation 3. A calculated minimum square error is named $\epsilon^m$ in the equation 3.

$$\min_{p^m,s^m} \sum_{k=0}^{1} \sum_{n=kN_s}^{(k+1)N_s-1} (s(n)-\tilde{s}_k(n-kN_s))^2 \quad \text{Eq. (3)}$$

$$\tilde{s}_k(n) = g_{p,k}x_k(n)*h_k(n)+g_{c,k}c_k(n)*h_k(n)+g_{c,k}c^m(n+kN_s)*h_k(n)$$

$$c^m(n) = s^m\delta(n-p^m)$$

Wherein s(n) is an original input speech signal and $h_k(n)$ is an impulse response of synthesis filter.

The gain compensation unit 123 computes a gain value for gain compensation from the object signal of Eq. (2) above, wherein it derives a gain for representing more precisely the gain obtained from the algebraic codebook search at the excitation signal modeling unit 103 of the core speech coding unit 110. That is, the gain compensation unit 123 finds a gain compensation value $g^m$ which satisfies the following equation 4, and a calculated minimum square error is named $\epsilon^g$.

$$\min_{g^m} \sum_{k=0}^{1} \sum_{n=kN_s}^{(k+1)N_s-1} (s(n)-\overline{s_k}(n-kN_s))^2 \quad \text{Eq. (4)}$$

$$\overline{s_k}(n) = g_{p,k}x_k(n)*h_k(n)+g^m g_{c,k}c_k(n)*h_k(n)$$

Wherein s(n) is an original input speech signal and $h_k(n)$ is an impulse response of synthesis filter.

The excitation signal model selection unit 124 selects a better mode based on the transmission rate between a multiple pulse search mode and a gain compensation mode. That is, the excitation signal model selection unit 124 compares the minimum square error $\epsilon^m$ calculated at the multiple pulse search unit 122 with the minimum square error $\epsilon^g$ calculated at the gain compensation unit 123, wherein it quantizes a position $p^m$ a sign $s^m$ of the pulse when $\epsilon^m$ is less than $\epsilon^g$, and a gain compensation value $g^m$ when $\epsilon^m$ is greater than $\epsilon^g$.

In addition, the excitation signal model selection unit 124 determines whether it repeats an algorithm proposed according to a limited value against a bit rate increase provided at the transmission rate determination unit 130. If it determines to repeat the algorithm, the excitation signal model selection unit 124 updates parameters and repeats an embedded excitation signal modeling. In other words, in case where the excitation signal is modeled based on the multiple pulse search mode, the excitation signal model selection unit 124 updates the algebraic codebook excitation signal according to the following equation 5-1; and in case where the gain of excitation signal is compensated based on the gain compensation mode, it updates the algebraic codebook gain value according to the following equation 5-2 and repeats the embedded excitation signal modeling.

$$c_k(n)=c_k(n)+c^m(n+kN_s) \quad \text{Eq. (5-1)}$$

$$g_{c,k}=g^m \cdot g_{c,k} \quad \text{Eq. (5-2)}$$

Figure 3:
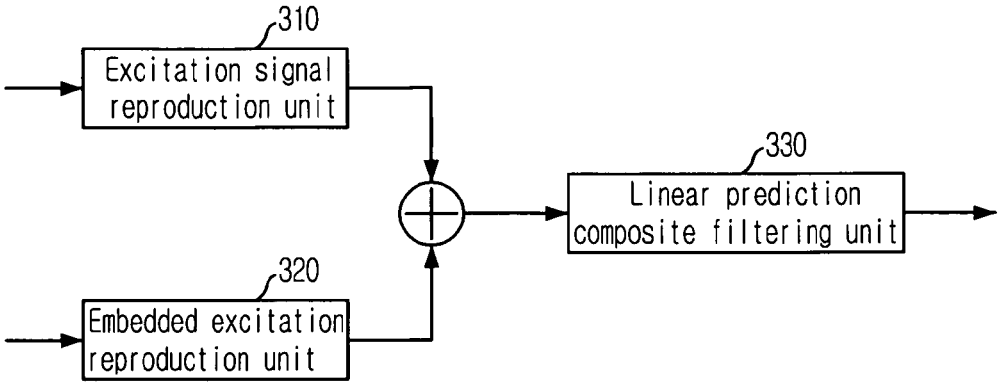
FIG. 3 is a block diagram of an embedded code-excited linear prediction speech decoding apparatus in accordance with one embodiment of the present invention.

FIG. 3 is a block diagram illustrating one embodiment of an embedded code-excited linear prediction speech decoding apparatus in accordance with the present invention As shown in FIG. 3, the embedded code-excited linear prediction speech decoding apparatus in accordance with the present invention comprises an excitation signal reproduction unit 310, an embedded excitation reproduction unit 320 and a linear prediction synthesis filtering unit 330.

The excitation signal reproduction unit 310 synthesis an excitation signal using an adaptive codebook and an algebraic codebook information of core speech coder, and the embedded excitation reproduction unit 320 decodes an excitation signal from a bit stream which is added in an embedded type to improve the quality of speech. The decoded excitation signals from the excitation signal reproduction unit 310 and the embedded excitation reproduction unit 320 are inputed to the linear prediction synthesis filtering unit 330 which reconstructs a speech signal by a linear prediction synthesis filtering. At this time, the embedded excitation reproduction unit 320 decodes an excitation signal using the pulse position and sign that are transmitted from the embedded code-excited linear prediction speech coding apparatus in accordance with the present invention, or decodes an excitation signal using an excitation codebook gain value.

Figure 4:
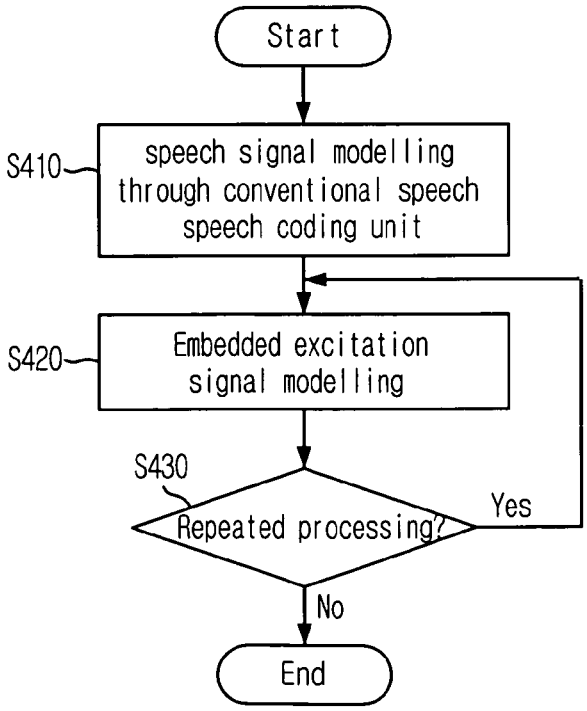
FIG. 4 is a flowchart describing an embedded code-excited linear prediction speech coding method in accordance with one embodiment of the present invention.

FIG. 4 is a flowchart illustrating one embodiment of an embedded code-excited linear prediction speech coding method in accordance with the present invention As shown in FIG. 4, first process of the invention is coding of input signal by using a conventional speech coder at step S410. For example, it is assumed that the conventional speech coder is ITU-T G.729 and a given one frame is divided into two subframes. And a codebook result value at a kth subframe is defined as follows:

$x_k(n)$: adaptive codebook excitation signal $g_{p,k}$: adaptive codebook gain value $c_k(n)$: algebraic codebook excitation signal $g_{c,k}$: algebraic codebook gain value $N_s$: the number of samples of subframe At a next step S420, an embedded excitation signal modeling for a residual excitation signal which is not codec at the conventional speech coder is conducted depending on the transmission rate. That is, an excitation signal of speech which is not modeled in the conventional speech coder is modeled as a pulse position and sign of multiple pulse and as a gain compensation coefficient; and then an optimum one of the two modes is selected. Then the position and sign of multiple pulses or the gain compensation coefficients is quantized according to the selected mode. A detailed description will be provided later referring to FIG. 5.

Subsequently, at step S430, the process determines whether it would repeatedly perform an embedded excitation signal modeling according to a limited value against a given bit rate increase.

If the process determines to repeatedly perform to satisfy the given bitrates, the object signal for embedded excitation modeling is updated according to the Eq. (5) and repeats the above steps.

Figure 5:
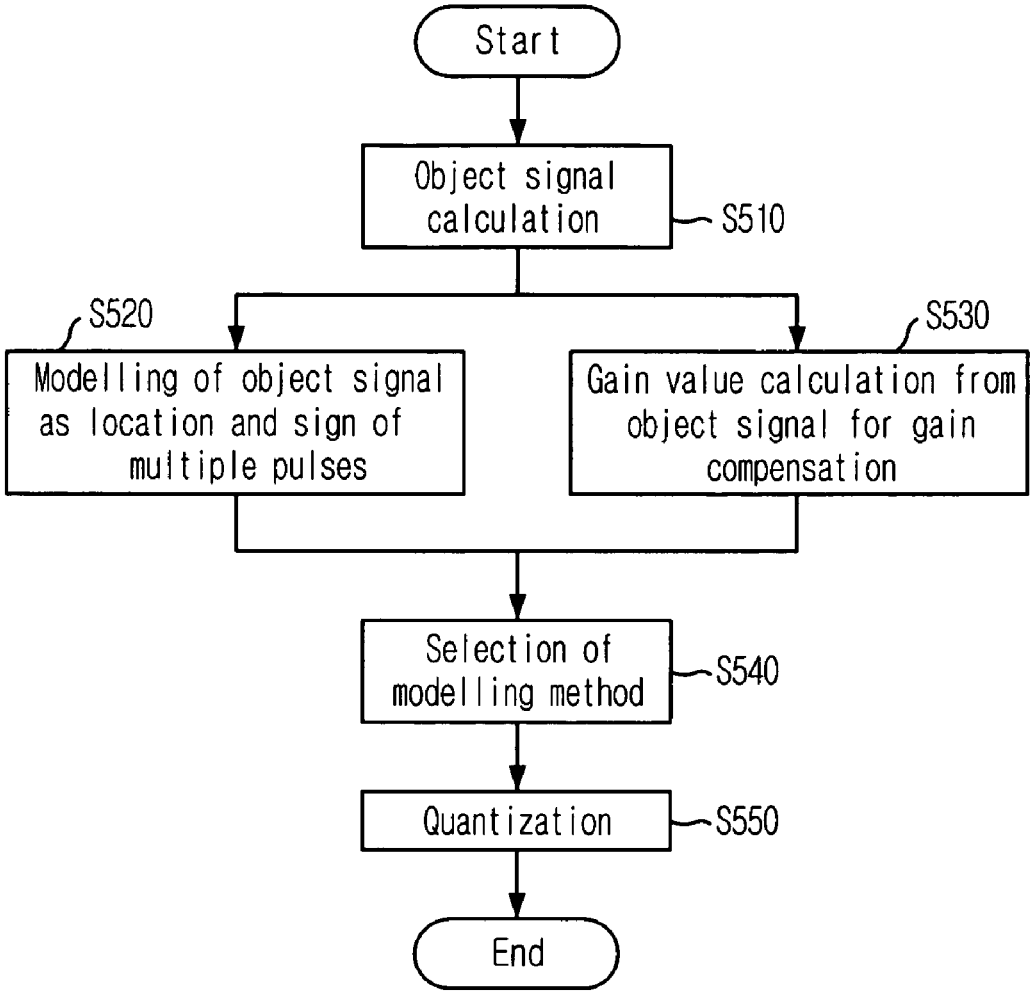
FIG. 5 is a flowchart describing the embedded excitation signal modeling process shown in FIG. 4 in detail.

FIG. 5 is a flowchart describing the embedded excitation signal modeling process shown in FIG. 4.

As shown in FIG. 5, at step S510, an object signal for the embedded excitation signal modeling is calculated. That is, the excitation signal is reconstructed by the contributions of an algebraic codebook and an adaptive codebook which are computed in a conventional speech coder and a linear prediction synthesis filtering is performed; and then subtracts the filtered signal from the original speech signal. The object input signal may be calculated according to the following equations 6 and 7.

$$s(n)-(g_{p,k}x_k(n)*h_k(n)+g_{c,k}c_k(n)*h_k(n)) \quad \text{Eq. (6)}$$

$$s(n)-(g_{p,k}x_k(n)*h_k(n)+g^m g_{c,k}c_k(n)*h_k(n)) \quad \text{Eq. (7)}$$

Thereafter, the calculated object signal is coded with a position and a sign of multiple pulses at step S520. That is to say, the process finds a pulse position and a sign which put the greatest influence on the speech quality using the object signal of Eq. (6) above, wherein it seeks a pulse location $p^m$ and a pulse sign $s^m$ at that pulse position which satisfies the following equation 8 and a calculated minimum square error in the equation 8 is named $\epsilon^m$.

$$\min_{p^m,s^m} \sum_{k=0}^{1} \sum_{n=kN_s}^{(k+1)N_s-1} (s(n)-\tilde{s}_k(n-kN_s))^2 \quad \text{Eq. (8)}$$

$$\tilde{s}_k(n) = g_{p,k}x_k(n)*h_k(n)+g_{c,k}c_k(n)*h_k(n)+g_{c,k}c^m(n+kN_s)*h_k(n)$$

$$c^m(n)=s^m\delta(n-p^m)$$

At a subsequent step S530, the process obtains a gain value for gain compensation from the calculated object signal. In other words, the process derives a gain value for compensating the gain obtained from the algebraic codebook search at the conventional speech coder using the equation 7 wherein it finds a gain compensation value $g^m$ which satisfies the following equation 9 and a calculated minimum square error in equation 9 is named $\epsilon^g$.

$$\min_{g^m} \sum_{k=0}^{1} \sum_{n=kN_s}^{(k+1)N_s-1} (s(n)-\overline{s_k}(n-kN_s))^2 \quad \text{Eq. (9)}$$

$$\overline{s_k}(n) = g_{p,k}x_k(n)*h_k(n)+g^m g_{c,k}c_k(n)*h_k(n)$$

Next, the process selects the better one between the multiple pulse search mode and the gain compensation mode at step S540. Namely, the process compares the minimum square error $\epsilon^m$ calculated at step S520 with a minimum square error $\epsilon^g$ calculated at step S530; and selects the multiple pulse search mode at S520 when $\epsilon^m$ is less than $\epsilon^g$ and the gain compensation mode at S530 when $\epsilon^m$ is greater than $\epsilon^g$.

At step S550, the process quantizes the result value according to the selected mode. That is, when the multiple pulse search mode is selected, the process quantizes a position $p^m$ and a sign $s^m$ of pulse which have minimum mean square error, and when the gain compensation mode is selected, the process quantizes a gain compensation value $g^m$.

Figures 6, 7:
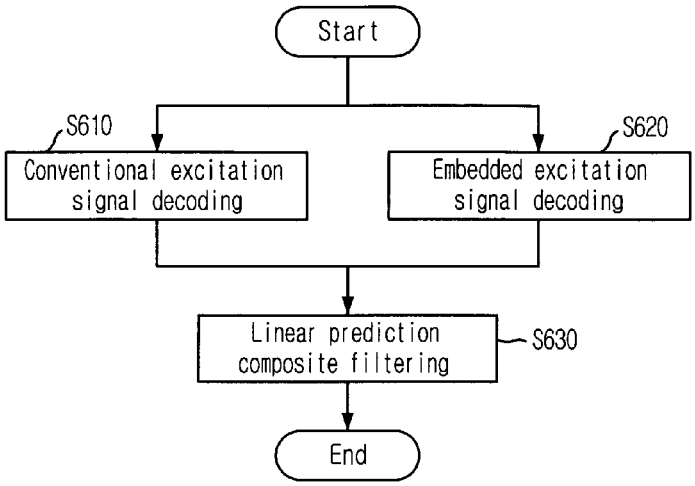
FIG. 6 is a flowchart describing an embedded code-excited linear prediction speech decoding method in accordance with one embodiment of the present invention.
FIG. 7 is a view showing a performance result of the embedded code-excited linear prediction speech coding apparatus in accordance with one embodiment of the present invention.

FIG. 6 is a flowchart illustrating one embodiment of an embedded code excitation linear prediction speech decoding method in accordance with the present invention.

As shown in FIG. 6, at a first step S610, the process of the invention synthesis the original excitation signal using an adaptive codebook and an algebraic codebook information that are transmitted from a conventional speech encoder.

At a next step S620, an excitation signal is reconstructed and added in an reconstructed embedded type excitation to improve the speech quality according to the present invention. At this time, an excitation signal using the position and sign of pulse which are transmitted from the embedded code excitation linear prediction speech encoding apparatus in accordance with the present invention, or decodes an excitation signal using an excitation codebook gain value.

Thereafter, at step S630, the process recovers a speech signal by conducting a linear prediction synthesis filtering of the excitation signals decoded at steps S610 and S620.

FIG. 7 is a view illustrating a performance of the embedded code-excited linear prediction speech coding apparatus in accordance with one embodiment of the present invention. FIG. 7 shows the objective speech quality test results calculated at each bit rate given by the transmission determination unit 130 shown in FIG. 1 is changed, wherein the bit rate is changed at a rate of 0.8 kbits/s. At this time, all the bit rate changes include a bit rate at the previous process; and the core speech coding unit 110 of the speech coding apparatus of the present invention uses an Algebraic Code-Exited Linear Prediction (ACELP) which has a transmission rate of 9.5 kbits/s modified based on ITU-T G.729.

Further, ITU-T P.862 (ITU-T Recommendation P.862, Perceptual evaluation of speech quality (PESQ), an objective method for end-to-end speech quality assessment of narrowband telephone networks and speech codecs, February, 2001) which is one of standards objective quality measure is used for the speech quality test.

As shown in FIG. 7, the status of determination on the multiple pulse search mode or the gain compensation mode is shown in the 3rd row and the speech quality shows an increases of 0.013 MOS when a bit rate of 0.8 kbits/s increases. That is, it can be seen that the speech quality is improved gradually in accordance with bitrates increment.

The method of the present invention as mentioned above may be implemented by a software program and stored in computer-readable storage medium such as CD-ROM, RAM, ROM, floppy disk, hard disk, optical magnetic disk, etc. This process may be readily carried out by those skilled in the art; and therefore, details of thereof are omitted here.

The present invention as described early can provide a gradual high quality speech service according to a change of a transmission rate in a speech service such as VoIP, etc. and also provide a different speech quality depending on the needs and cost of a user.

The present application contains subject matter related to Korean patent application Nos. 2004-0103156 and 2005-0077355, filed with the Korean Intellectual Property Office on Dec. 8, 2004, and Aug. 23, 2005, the entire contents of which are incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. A speech coding apparatus comprising:

a core speech coding unit which presents a speech signal with an excitation signal;

a transmission rate determination unit which allocates the number of bits that are additionally allowed due to a capacity change in a transmission channel; and an embedded excitation signal coding unit for determining which one of a multiple pulse excitation coding method and a gain compensation method is optimal for coding a residual excitation signal, that is not coded in the core speech coding unit, with the additionally allowed bits, and generating the residual excitation signal coded by the determined method, wherein the gain compensation method derives a gain compensation value for compensating a gain obtained from an algebraic codebook search, the gain compensation value being multiplied with the gain obtained from the algebraic codebook search to update the gain, wherein the embedded excitation signal coding unit comprises a multiple pulse search unit for selecting a position and a sign of multiple pulses that minimize a square error $\epsilon^m$ of the residual excitation signal, the embedded excitation signal coding unit further comprises a gain compensation unit for determining the gain compensation value that minimizes a square error $\epsilon^g$ of the residual excitation signal, and the embedded excitation signal coding unit compares $\epsilon^m$ with $\epsilon^g$, selects the multiple pulse excitation coding method when $\epsilon^m<\epsilon^g$, and selects the gain compensation method when $\epsilon^m>\epsilon^g$.

2. The speech coding apparatus as recited in claim 1, wherein the embedded excitation signal coding unit includes:

an object signal calculation unit which calculates the residual excitation signal that is not coded in the core speech coding unit;

the multiple pulse search unit;

the gain compensation unit; and an excitation signal coding model selection unit for selecting a coding mode based on the minimum square errors of the multiple pulse search unit and the gain compensation unit.

3. The speech coding apparatus as recited in claim 2, wherein the object signal calculation unit adds the contributions of both an adaptive codebook and the algebraic codebook of the core speech coding unit, performs a linear prediction synthesis filtering and then subtracts the filtered signal from the original input signal.

4. The speech coding apparatus as recited in claim 2, wherein the multiple pulse search unit searches a pulse position $p^m$ and a sign $s^m$ of the pulse $p^m$ which satisfy the following equation:

$$\min_{p^m,s^m}\sum_{k=0}^{1}\sum_{n=kN_s}^{(k+1)N_s-1}(s(n)-\tilde{s}_k(n-kN_s))^2$$

$$\tilde{s}_k(n)=g_{p,k}x_k(n)*h_k(n)+g_{c,k}c_k(n)*h_k(n)+g_{c,k}c^m(n+kN_s)*h_k(n)$$

$$c^m(n)=s^m\delta(n-p^m)$$

where $x_k(n)$: adaptive codebook excitation signal, $g_{p,k}$: adaptive codebook gain value, $c_k(n)$: algebraic codebook excitation signal, $g_{c,k}$: algebraic codebook gain value, $N_s$: the number of samples of subframe, s(n): an original speech signal, and h(n): an impulse response of a composite filter.

5. The speech coding apparatus as recited in claim 2, wherein the gain compensation unit finds a gain compensation value $g^m$ which satisfies the following equation:

$$\min_{g^m}\sum_{k=0}^{1}\sum_{n=kN_s}^{(k+1)N_s-1}(s(n)-\overline{s_k}(n-kN_s))^2$$

$$\overline{s_k}(n)=g_{p,k}x_k(n)*h_k(n)+g^m g_{c,k}c_k(n)*h_k(n)$$

wherein $x_k(n)$: adaptive codebook excitation signal, $g_{p,k}$: adaptive codebook gain value, $c_k(n)$: algebraic codebook excitation signal, $g_{c,k}$: algebraic codebook gain value, $N_s$=the number of samples of subframe, s(n): an original speech signal, and h(n): an impulse response of a composite filter.

6. The speech coding apparatus as recited in claim 2, wherein the excitation signal coding model selection unit quantizes the position and sign of pulses which have the minimum square error calculated at the multiple pulse search unit is less than the minimum square error calculated at the gain compensation unit; and quantizes the gain compensation value when the minimum square error calculated at the gain compensation unit is less than the minimum square error calculated at the multiple pulse search unit.

7. A speech decoding apparatus comprising:

an excitation signal reproduction unit which reconstructs a basic excitation signal using an adaptive codebook index and gain, and an algebraic codebook index and gain of a core speech coder;

an embedded excitation signal reproduction unit for decoding a residual excitation signal from a bit stream added in an embedded type according to a determination made by an embedded coder as to which one of a multiple pulse excitation coding method and a gain compensation method is optimal for coding the residual excitation signal, that is not coded in the core speech coding unit, with the additionally allowed bits; and a linear prediction synthesis filter unit which reconstructs a speech signal by performing a linear prediction synthesis of the reconstructed basic excitation signal at the excitation signal reproduction unit and the decoded residual excitation signal at the embedded excitation signal reproduction unit, wherein the gain compensation method derives a gain compensation value for compensating a gain obtained from an algebraic codebook search, the gain compensation value being multiplied with the gain obtained from the algebraic codebook search to update the gain, and wherein the embedded coder selects a position and a sign of multiple pulses that minimize a square error $\epsilon^m$ of the residual excitation signal, determines the gain compensation value that minimizes a square error $\epsilon^g$ of the residual excitation signal, compares $\epsilon^m$ with $\epsilon^g$, selects the multiple pulse excitation coding method when $\epsilon^m<\epsilon^g$, and selects the gain compensation method when $\epsilon^m>\epsilon^g$.

8. The speech decoding apparatus as recited in claim 7, wherein the embedded excitation signal reproduction unit decodes the residual excitation signal using the position and the sign of the pulses which are quantized and transmitted.

9. The speech decoding apparatus as recited in claim 7, wherein the embedded excitation signal reproduction unit decodes the residual excitation signal using an excitation codebook gain value quantized and transmitted.

10. A speech coding method comprising the steps of:

a) presenting, by a speech coding apparatus, a speech signal with an excitation signal;

b) allocating, by the speech coding apparatus, the number of bits that are additionally allowed due to a capacity change in a transmission channel; and c) determining, by the speech coding apparatus, which one of a multiple pulse excitation coding method and a gain compensation method is optimal for coding a residual excitation signal, that is not coded in the core speech coding unit, with the additionally allowed bits, and generating the residual excitation signal coded by the determined method, wherein the gain compensation method derives a gain compensation value for compensating a gain obtained from an algebraic codebook search, the gain compensation value being multiplied with the gain obtained from the algebraic codebook search to update the gain, wherein the step c) comprises:

c1) calculating the residual excitation signal, c2) determining a pulse position and a sign which minimize a square error $\epsilon^m$ of the residual excitation signal;

c3) determining the gain compensation value which minimizes a square error $\epsilon^g$ of the residual excitation signal; and c4) comparing $\epsilon^m$ with $\epsilon^g$, selecting the multiple pulse excitation coding method when $\epsilon^m<\epsilon^g$, and selecting the gain compensation method when $\epsilon^m>\epsilon^g$.

11. The speech coding method as recited in claim 10, wherein said step c1) adds the contribution of an adaptive codebook and the algebraic codebook, performs linear prediction synthesis, and subtracts the filtered signal from the original input signal.

12. The speech coding method as recited in claim 10, wherein said step c2) finds a pulse position $p^m$ and a sign $s^m$ at the pulse $p^m$ satisfying the following equation:

$$\min_{p^m,s^m}\sum_{k=0}^{1}\sum_{n=kN_s}^{(k+1)N_s-1}(s(n)-\tilde{s}_k(n-kN_s))^2$$

-continued $$\tilde{s}_k(n)=g_{p,k}x_k(n)*h_k(n)+g_{c,k}c_k(n)*h_k(n)+g_{c,k}c^m(n+kN_s)*h_k(n)$$

$$c^m(n)=s^m\delta(n-p^m)$$

where $x_k(n)$: adaptive codebook excitation signal, $g_{p,k}$: adaptive codebook gain value, $c_k(n)$: algebraic codebook excitation signal, $g_{c,k}$: algebraic codebook gain value, $N_s$: the number of samples of subframe, s(n): an original speech signal, and h(n): an impulse response of a composite filter.

13. The speech coding method as recited in claim 10, wherein said step c3) finds the gain compensation value $g_m$ satisfying the following equation:

$$\min_{g^m}\sum_{k=0}^{1}\sum_{n=kN_s}^{(k+1)N_s-1}(s(n)-\overline{s_k}(n-kN_s))^2$$

$$\overline{s_k}(n)=g_{p,k}x_k(n)*h_k(n)+g^m g_{c,k}c_k(n)*h_k(n)$$

where $x_k(n)$: adaptive codebook excitation signal, $g_{p,k}$: adaptive codebook gain value, $c_k(n)$: algebraic codebook excitation signal, $g_{c,k}$: algebraic codebook gain value, $N_s$=the number of samples of subframe, s(n): an original speech signal, and h(n): an impulse response of composite filter.

14. The speech coding method as recited in claim 12, further comprising the step of repeatedly performing a parameter update according to the following equation and an embedded excitation signal coding $$c_k(n)=c_k(n)+c_m(n+kN_s)$$

$$g_{c,k}=g^m g_{c,k}.$$

15. The speech coding method as recited in claim 10, wherein said step c4) quantizes the positions and the signs of the pulse when the minimum square error calculated at said step c2) is less than the minimum square error calculated at said step c3), and quantizes the gain compensation value when the minimum square error calculated at said step c3) is less than the minimum square error calculated at said step c2).

16. A speech decoding method comprising the steps of:

a) reconstructing, by a speech decoding apparatus, a basic excitation signal using an adaptive codebook index and gain, and an algebraic codebook index and gain of a speech coder;

b) decoding, by the speech decoding apparatus, a residual excitation signal from a bit stream added in an embedded type according to a determination made by an embedded coder as to which one of a multiple pulse excitation coding method and a gain compensation method is optimal for coding the residual excitation signal, that is not coded in the core speech coding unit, with the additionally allowed bits; and c) reconstructing, by the speech decoding apparatus, a speech signal by performing a linear prediction synthesis of the reconstructed basic excitation signal and the decoded residual excitation signal, wherein the gain compensation method derives a gain compensation value for compensating a gain obtained from an algebraic codebook search, the gain compensation value being multiplied with the gain obtained from the algebraic codebook search to update the gain, wherein the embedded coder selects a position and a sign of multiple pulses that minimize a square error $\epsilon^m$ of the residual excitation signal, determines the gain compensation value that minimizes a square error $\epsilon^g$ of the residual excitation signal, compares $\epsilon^m$ with $\epsilon^g$, selects the multiple pulse excitation coding method when $\epsilon^m<\epsilon^g$, and selects the gain compensation method when $\epsilon^m>\epsilon^g$.

17. The speech decoding method as recited in claim 16, wherein said step b) decodes the residual excitation signal based on using the position and the sign of the pulses which are quantized and transmitted.

18. The speech decoding method as recited in claim 16, wherein said step b) decodes the residual excitation signal using an excitation codebook gain value that is quantized and transmitted.

* * * * *